US005802430A

United States Patent [19]

Wada

[11] Patent Number: 5,802,430

[45] Date of Patent: Sep. 1, 1998

[54] IMAGE FORMING APPARATUS HAVING MEANS FOR ADSORBING IMPURITIES CONTAINED IN THE TONER RETURNED BY THE RECYCLING MECHANISM

[75] Inventor: Hidekatsu Wada, Chiba-ken, Japan

[73] Assignee: Kabushiki Kaishi Toshiba, Kawasaki, Japan

[21] Appl. No.: 826,370

[22] Filed: Apr. 9, 1997

[30] Foreign Application Priority Data

Apr. 22, 1996 [JP] Japan ..... 8-100176

[51] Int. Cl.[6] ..... G03G 15/06; G03G 21/00

[52] U.S. Cl. ..... 399/253; 399/98

[58] Field of Search ..... 399/98, 267, 270, 399/358, 359, 149, 150, 253; 430/125; 209/615–618

[56] References Cited

U.S. PATENT DOCUMENTS

| | | | |
|---|---|---|---|
| 3,645,618 | 2/1972 | Lancia et al. | 430/125 X |
| 4,639,115 | 1/1987 | Lin | 399/253 |
| 4,768,055 | 8/1988 | Takamatsu et al. | 399/359 X |
| 5,153,642 | 10/1992 | Folkins et al. | 399/253 |
| 5,231,458 | 7/1993 | Nishimura | 399/523 |

FOREIGN PATENT DOCUMENTS

| | | |
|---|---|---|
| 57-70572 | 5/1982 | Japan . |
| 59-101678 | 6/1984 | Japan . |
| 60-69675 | 4/1985 | Japan . |
| 61-228478 | 10/1986 | Japan . |
| 5-313543 | 11/1993 | Japan . |

*Primary Examiner*—Arthur T. Grimley
*Assistant Examiner*—Sophia S. Chen
*Attorney, Agent, or Firm*—Foley & Lardner

[57] ABSTRACT

An image forming apparatus of the present invention includes a developing device for forming a developed image by transferring a developing agent to an electrostatic latent image formed on a photosensitive drum, a developing agent recycling mechanism for returning the developing agent recovered from the photosensitive drum by a cleaning device to the developing device after transferring the developed image formed on the photosensitive drum on a sheet paper, and a contact member for adsorbing impurities contained in the developing agent returned by the recycling mechanism by an adsorbing voltage having a voltage and polarity defined based on the charged polarity of the developing agent and the developing bias voltage applied to the developing roller and the developing agent of the developing device.

12 Claims, 6 Drawing Sheets

IMAGE FORMING APPARATUS HAVING MEANS FOR ADSORBING IMPURITIES CONTAINED IN THE TONER RETURNED BY THE RECYCLING MECHANISM

BACKGROUND OF THE INVENTION

1. Field of the Invention

The present invention relates to an image forming apparatus which is capable of obtaining stabilized images using toners recovered for recycling by a toner recycling mechanism.

2. Description of the Related Art

An image forming apparatus using an electrophotographic process forms an electrostatic latent image by giving a prescribed potential to a photosensitive member which has photoelectric conductivity and by attenuating the potential by applying light corresponding to the image. Then, a copied image of a copying object or an image to be printed is obtained by feeding a toner as a developing agent to the electrostatic latent image.

A two-component developing agent is composed of a toner and the carrier containing a magnetic material. The toner is adhered to the carrier which is adhered to a magnetic roller in the shape of a brush. The toner separated from the carrier is adsorbed into an electrostatic latent image and a toner image is formed on the photosensitive member.

Further, when an electrostatic latent image formed on a photosensitive member is developed, a toner (hereinafter, referred to as a fresh toner) in the amount corresponding to the decreased toner is replenished from a toner replenishing device arranged at a prescribed position of a developing device.

The toner image formed on the photosensitive member is transferred on a copying material, for instance, a recording sheet paper and fixed thereon by a fixing device.

On the other hand, untransferred toner left on the photosensitive member is removed therefrom by a cleaning device.

The toner (waste toner) removed from the photosensitive member by the cleaning device is recovered in a prescribed recovery device and disposed of as waste matter.

In recent years, however, there has been proposed a toner recycling mechanism which recovers waste toner in a developing device or a toner hopper (a toner replenishing device) connected to a developing device for reuse by the developing device.

By using waste toner recovered by the toner recycling mechanism in the developing process, the number of copies for image forming increases, the necessity for disposing waste toner of an image forming apparatus is eliminated and user is less troubled.

However, when a latent image is developed using a toner recycled (hereinafter referred to as a recycle toner) by the toner recycling mechanism by mixing with fresh toner, such defects may be caused as undesirable toner drop in the region other than a toner image on a transfer paper, the partial image void or the fog of a white ground of a transfer paper.

It is known that frequency of generating such defects increases with the increase in cumulative total of the number of copies and when residual quantity of fresh toner in the toner replenishing device reaches a prescribed amount or less.

SUMMARY OF THE INVENTION

It is an object of the present invention to provide an image forming apparatus which is capable of utilizing recycle toner efficiently and obtaining stabilized images.

According to the present invention, there is provided an image forming apparatus comprising means for forming an electrostatic latent image on an image carrier, a developing agent carrying member for carrying a developing agent which is charged with a prescribed polarity and for supplying the developing agent to the electrostatic latent image to form a developed image, first applying means for applying a prescribed developing bias voltage to the developing agent carrying member, a contact member for contacting with the developing agent carried on the developing agent carrying member in brush shape, and second applying means for applying an adsorbing voltage having a predetermined polarity and voltage defined by the prescribed polarity of the developing agent and the developing bias voltage so that the contact member adsorbs impurities contained in the developing agent carried on the developing agent carrying member in brush shape.

DESCRIPTION OF THE PREFERRED EMBODIMENTS

Figure 1:
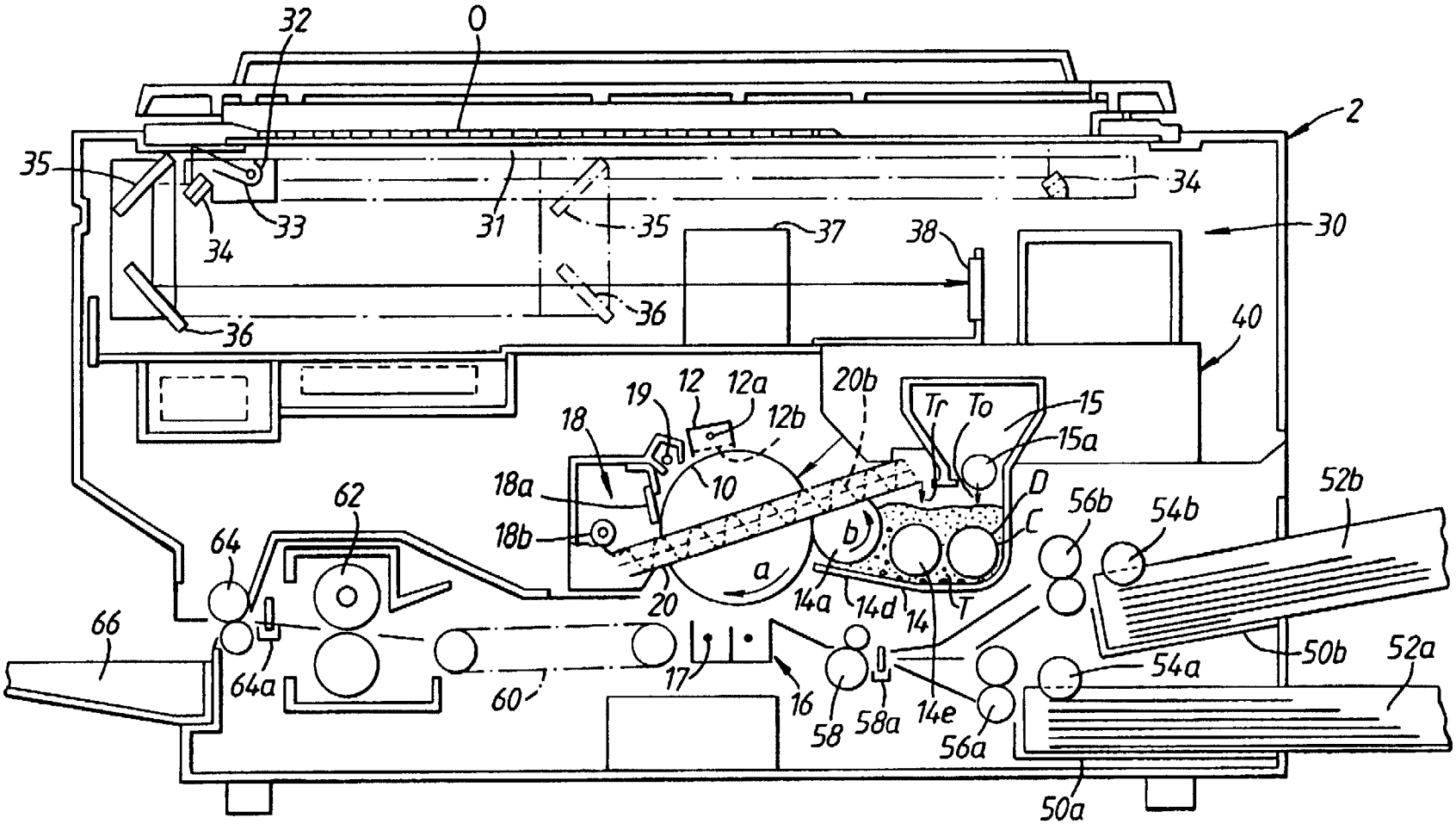
FIG. 1 is a schematic sectional view of an image forming apparatus illustrating one embodiment of the present invention.

Hereinafter, preferred embodiments of the present invention will be described referring to the drawings.

Figure 2:
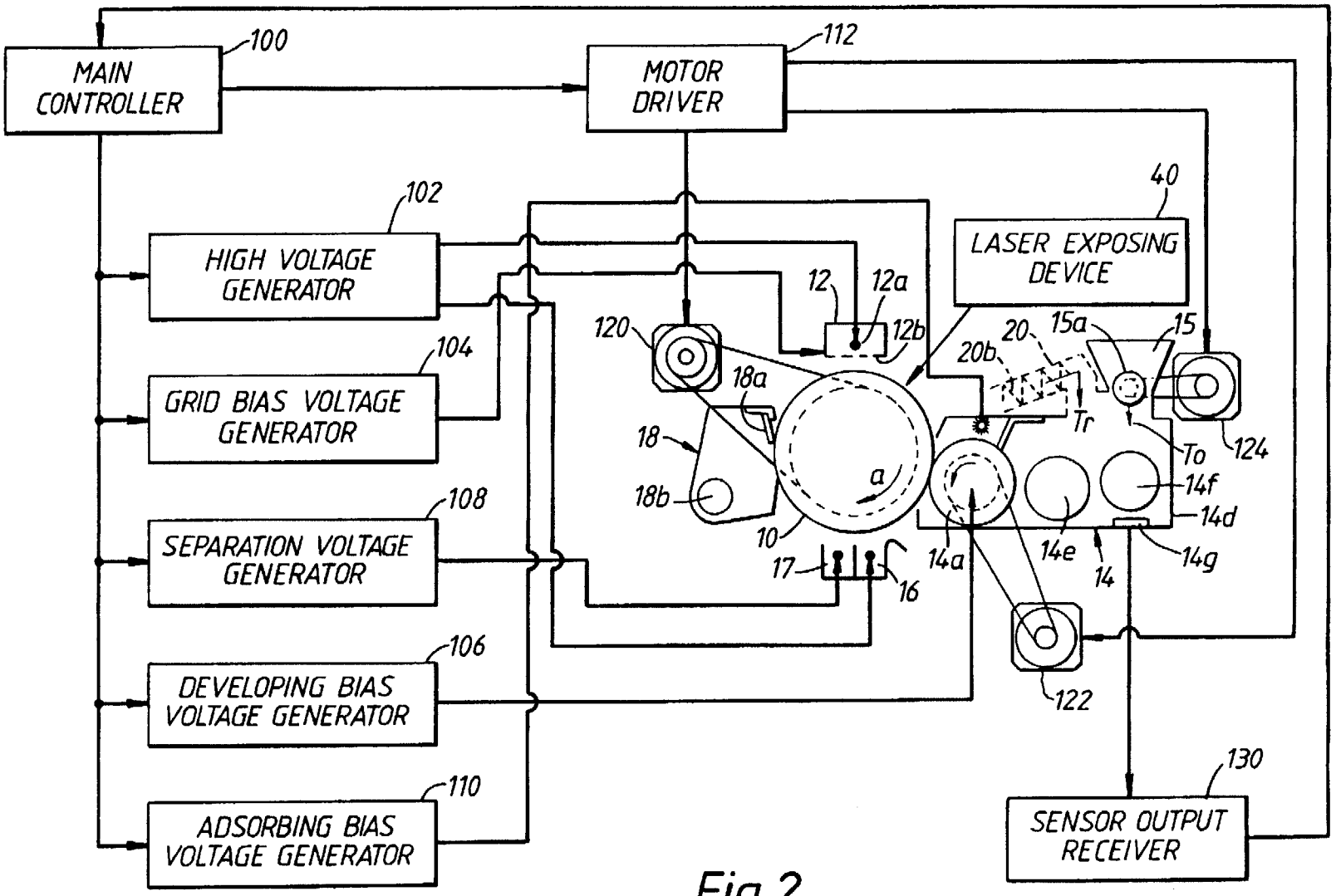
FIG. 2 is a block diagram illustrating the relation of connection of a control circuit which controls mechanical units and each mechanical unit of the image forming apparatus shown in FIG. 1.

As illustrated in FIG. 1 and FIG. 2, an image forming apparatus, that is, a laser exposure copying machine 2 is equipped with a photosensitive drum 10 rotatably at about the center of the main body of the machine. The photosensitive drum 10 is rotated in the direction of an arrow a by a main motor 120.

On the surface of the photosensitive drum 10, an electrostatic latent image is formed corresponding to an image to be recorded or copied by a laser beam from a laser exposing device which is described later.

Around the photosensitive drum 10, there are arranged a main charger 12 to give a prescribed surface potential to the photosensitive layer of the photosensitive drum 10, a developing device 14 to develop an electrostatic latent image by supplying a toner as a developing agent to the electrostatic latent image formed on the photosensitive drum 10 by the laser exposing device, a transferring device 16 to transfer a toner image formed on the photosensitive drum 10 by the developing device 14 on a sheet paper, a cleaning device 18 to scrape off the toner, that is, untransferred toner left on the surface of the photosensitive drum 10, and a charge removing device 19 to remove charge remained on the surface of the photosensitive drum 10 in order along the direction of rotation shown by the arrow a. The charge removing device 19 is arranged in the housing of the cleaning device 18 in one body.

A toner hopper 15 is provided in the developing device 14 in one body to replenish a toner in a housing **14*d* of the developing device 14 from the outside. Between a housing 14*d* and the cleaning device 18, a toner recycling mechanism 20 is connected. The toner recycling mechanism 20 returns the untransferred toner recovered by the cleaning device 18 in the housing 14*d* of the developing device 14 (or the toner hopper 15**).

The main charger 12 includes a corona wire **12*a* and a grid screen 12*b*, and is connected to a high voltage generator 102 and a grid bias voltage generator 104 and gives a prescribed surface potential to the surface of the photosensitive drum 10**.

In the housing **14*d* of the developing device 14, there is housed a two-component developing agent D in which a toner T of non-magnetic material and the carrier C of magnetic material are mixed at a prescribed ratio. Further, a developing roller 14*a* is housed in the housing 14*d*. The developing roller 14*a* makes a negative charged toner T to adhere to an electrostatic latent image formed on the photosensitive drum 10 by the developing bias voltage supplied from the developing bias voltage generator 106** while holding the negative charged toner T at its outer surface.

There is arranged an agitating roller **14*f* at the side of the housing 14*d* opposite to the other end where the developing roller 14*a*** is arranged.

At the lower end of the toner hopper 15 that is opposite to the agitating roller **14*f*, a toner replenishing roller 15*a* is arranged rotatably. A motor 124 is connected to the toner replenishing roller 15*a* via a transmission belt. The motor 124 is connected to a motor driving circuit 112. The toner replenishing roller 15*a* is driven by the rotation of the motor 124 driven by the motor driving circuit 112. By the rotation of the toner replenishing roller 15*a*, the toner contained in the toner hopper 15 is replenished onto the agitating roller 14*f***.

A prescribed developing bias voltage is applied to the developing roller **14*a* and a developing agent D composed of the carrier C and the toner T from the developing bias voltage generator 106**.

The developing roller **14*a* has S-poles and N-poles arranged alternately at a prescribed angle in the circumferential direction and is composed of a fixed magnetic member 14*b* and a non-magnetic sleeve 14*c* which rotates in the direction of an arrow b around the magnetic member 14*b***.

The non-magnetic sleeve **14*c* is driven by a motor 122 connected to the motor driving circuit 112. The sleeve 14*c* is rotated so that its moving speed becomes about 2 times of the moving speed of the surface of the photosensitive drum 10**.

Figure 4:
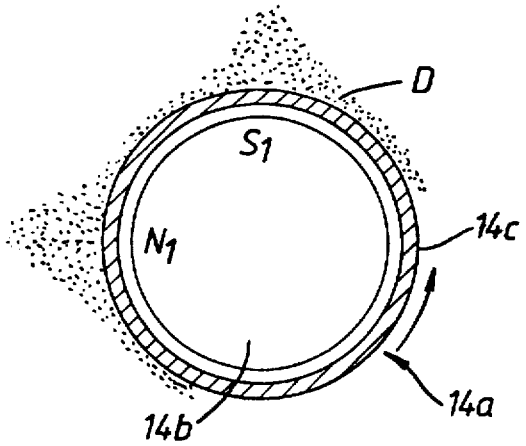
FIG. 4 is a schematic sectional view exaggeratingly illustrating the state of a developing agent adhered to only the magnetic poles $N_1$ and $S_1$, of a developing roller of the developing device shown in FIG. 3.

As illustrated in FIG. 4, the carrier C with the toner T adhered by an image force is adhered to the sleeve **14*c* in the shape of a brush or in the shape of ear along the magnetic flux formed on the magnetic poles $N_1$, $S_1$, $N_2$, $S_2$ and $N_3$ portions of the magnetic member 14*b*. The twocomponent developing agent D composed of the toner T and the carrier C is formed in the shape of a brush while being conveyed along the circumferential direction on the sleeve 14*c* by the rotation of the sleeve 14*c***.

At the position on the outer surface of the developing roller **14*a* and opposite to the contacting side with the photosensitive drum 10, a feeding roller 14*e* is arranged to feed the toner T contained in the toner hopper 15 to the developing roller 14*a***.

The feeding roller **14*e* is rotated so that the moving directions of the outer surface of the feeding roller 14*e* and that of the developing roller 14*a*** are reversed each other at a position where they are brought in contact with each other.

In the developing region wherein the photosensitive drum 10 and the developing roller **14*a* are opposed to each other, the toner T is separated from the carrier C and moved toward a latent image by the electric field formed by the potential of an electrostatic latent image on the photosensitive drum 10 and the developing bias voltage. The toner T moved toward the electrostatic latent image is adhered to the latent image, forming a visible image. That is, the electrostatic latent image formed on the photosensitive drum 10** is developed.

The transferring device 16 and the separating device 17 are constructed in one united body. The transferring device 16 is connected to the high voltage generator 102 and the separating device 17 is connected to a separation voltage generator 108. The visible image developed on the photosensitive drum 10 is transferred on a recording paper P electrostatically by the transferring device 16. The recording paper P carrying the transferred visible image is separated from the photosensitive drum 10 by the separating device 17.

The cleaning device 18 is composed of a blade **18*a* and an auger 18*b*. The blade 18*a* is kept in contact with the surface of the photosensitive drum 10 under pressure and scrapes off the untransferred toner left on the surface of the photosensitive drum 10. The auger 18*b* conveys the toner T scraped off by the blade 18*a* to the toner recycling mechanism 20 provided at the end of the axial direction of the photosensitive drum 10**.

The charge removing device 19 is lighted to apply a prescribed quantity of light to the photosensitive drum 10 via a lamp regulator (a lighting circuit) (not shown) to erase the residual potential left on the surface of the photosensitive drum 10.

At the upper part of the photosensitive drum 10, that is, the upper part of the main body of the image forming apparatus, there is provided an image reading unit 30 to read an image of an original document O that is an object to be copied as a brightness source of light.

The image reading unit 30 has a platen glass 31 to hold an original document O, a lamp 32 to illuminate the original document O placed on the platen glass 31, a reflector 33 to condense the illuminating light applied from the lamp 32, a first mirror 34 to bend the reflected light from the original document O, a second mirror 35 and a third mirror 36 to bend the light reflected from the original document O and bent by the first mirror 34 and transmits an image of the original document O placed on the platen glass 31 to a CCD sensor 38 as the brightness data of light.

In the area including the optical axis of the light returned by the third mirror 36, there are arranged an imaging lens 37 which focuses the reflected light from the original document O and the CCD sensor 38 which photoelectrically converts the reflected light focused by the imaging lens 37.

At a position near the photosensitive drum 10, wherein the light can be applied to the surface of the photosensitive drum 10 corresponding to an image on an original document, a laser exposing device 40 is arranged to apply a laser beam of which intensity is changed based on an image to the surface of the photosensitive drum 10 with a prescribed surface potential given by the main charger 12.

At a position corresponding to the upper stream side of the paper conveying path in the direction toward the photosensitive drum 10, a first and a second slots 50*a* and 50*b* are provided. First and second paper cassettes 52*a* and 52*b* are inserted into these first and second slots 50*a* and 50*b* to feed recording paper to the photosensitive drum 10 by way of the paper P conveying path.

Along the paper conveying paths between the photosensitive drum 10 and the paper cassettes 52*a* and 52*b*, there are arranged paper feeding rollers 54*a* and 54*b* to take paper P out of the paper cassettes 52*a* and 52*b* one sheet at a P time, conveyor rollers 56*a* and 56*b* to convey the paper taken out by the paper feeding rollers 54*a* and 54*b* to the photosensitive drum 10, and an aligning roller 58 to temporarily stop the paper P being conveyed to the photosensitive drum 10 by the conveyor rollers 56*a* and 56*b*. When the paper P being fed is stopped by the aligning roller 58, the tilt of the paper P against its conveying direction is corrected and the leading edge of a toner image on the photosensitive drum 10 is aligned with the leading edge of the paper P and a timing to send out paper at a speed equal to the moving speed of the surface of the photosensitive drum 10 is created.

Near the aligning roller 58, there is arranged an aligning switch 58*a* which detects the leading edge of paper P being conveyed in order to stop the paper via the aligning roller 58.

Along the paper conveying path corresponding to the downstream in the rotating direction of the photosensitive drum 10, there are arranged a conveyor belt 60, a fixing device 62, a discharging roller 64 and a receiving tray 66 in order. The conveyor belt 60 conveys a sheet paper P carrying a visible toner image formed and transferred from the photosensitive drum 10 and adhered electrostatically thereon. The fixing device 62 fixes a visible image on a sheet paper P by heating and pressing the toner transferred on the paper P. The discharging roller 64 discharges a sheet paper P carrying a fixed visible image on the receiving tray 66 outside the copying machine.

Near the discharging roller 64, a discharge sensing switch 64*a* is arranged to sense whether there exists a sheet paper P between the fixing device 62 and the discharging roller 64. When sensing the trailing edge of a sheet paper P, the discharge sensing switch 64*a* detects the completion of the image formation on a sheet paper P currently being conveyed.

Figure 3:
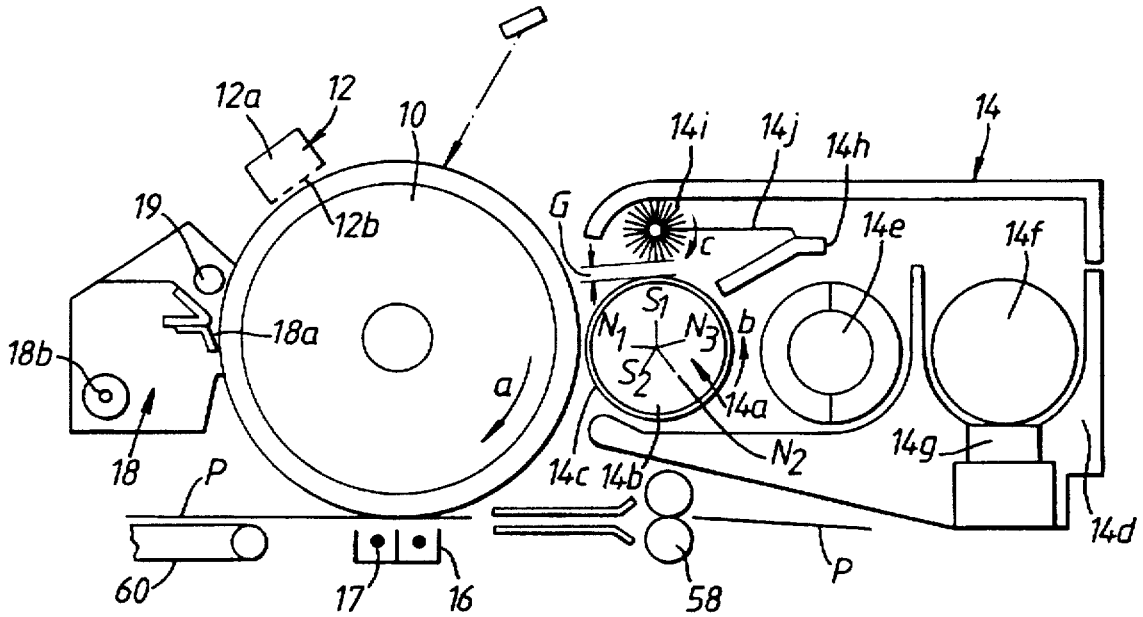
FIG. 3 is a schematic enlarged sectional view illustrating a first embodiment of a developing device that is used in the image forming apparatus shown in FIG. 1.

In FIG. 3 the developing device incorporated in the copying machine shown in FIG. 1, using a recycle toner is shown in detail.

As shown in FIG. 3, the developing device 14 holds the developing roller 14*a* and has the housing 14*d* to keep a distance between the developing roller 14*a* and the surface of the photosensitive drum 10 at a prescribed interval. In the housing 14*d*, the feeding roller 14*e* to feed a developing agent to the developing roller 14*a* and the agitating roller 14*f* to feed the toner To the feeding roller 14*e* and agitate a replenishing toner are arranged along the axis of the developing roller 14*a*.

In the sleeve 14*c*, there is fixed the magnetic member 14*b* on which the $N_1$ pole (the main pole) which forms a magnetic brush for adhering the toner To an electrostatic latent image on the photosensitive drum 10, the $S_2$ and the $N_2$ poles which convey a developing agent to the feeding roller 14*e* from the $N_1$ pole when the sleeve 14*c* is rotated, and the $N_3$ and the $S_1$ poles which convey a developing agent to the $N_1$ pole from the feeding roller 14*e* are arranged at a prescribed angle. The sleeve 14*c* is rotated by a motor 122 connected to the motor driving circuit 112 as explained in the above using FIG. 2.

The feeding roller 14*e* and the agitating roller 14*f* are rotated by the turning force transmitted from the developing roller 14*a* or the motor 122 in the same direction as the rotating direction of the developing roller 14*a*. That is, they are rotated so that the moving direction of the outer surface of the sleeve 14*c* is turned in the direction reverse to the moving direction of the outer surface of the feeding roller 14*e* at the position where both of them are brought in contact with each other.

In the housing 14*d*, a toner concentration sensor 14*g* is arranged below the agitating roller 14*f*. As shown in FIG. 2, the toner concentration sensor 14*g* is electrically connected with the sensor output receiver 130, and the sensor output receiver 130 is connected with the main controller 100. The toner concentration sensor 14*g* detects a change in the permeability of a developing agent and informs a mixing ratio of the toner T with the carrier C, that is, the toner concentration to the main controller 100. The toner concentration sensor 14*g* detects a voltage that is output based on the permeability when agitating a developing agent that is mixed from the toner and the carrier at a prescribed ratio and outputs DC voltage proportional to the mixing ratio of the toner and the carrier to the main controller 100.

At the position between the developing roller 14*a* and the feeding roller 14*e* and opposite to a position between the $N_3$ pole and the $S_1$ pole of the outer surface of the developing roller 14*a*, a doctor blade 14*h* is fixed to restrict amount of a developing agent (a thickness of a developing agent adhered to the outer surface of the sleeve 14*c*) fed to the developing roller 14*a* by the feeding roller 14*e* to a prescribed thickness.

Between the developing roller 14*a* and the top cover portion of the housing 14*d*, an adsorbing roller 14*i* is arranged. The absorbing roller 14*i* is rotated in a direction shown by an arrow c by a driving mechanism (not shown). That is, the adsorbing roller 14*i* is arranged at a position opposite to a position where a developing agent restricted to a prescribed thickness by the $S_1$ pole of the developing roller 14*a*, that is, the doctor blade 14*h* is raised in the shape of a brush by the $S_1$ pole. The adsorbing roller 14*i* electrostatically adsorbs and recovers impurities contained in the developing agent, for instance, fiber or additives generated from paper contained in recycle toner Tr recycled by the toner recycling mechanism 20 while the developing agent is being conveyed by the developing roller 14*a*.

The adsorbing roller 14*i* is composed of a conductive brush having a conductive brush portion implanted in a metallic shaft, of which resistance is restricted to a prescribed level. A prescribed bias voltage is applied to the adsorbing roller 14*i* from an adsorbing bias voltage generator 110 shown in FIG. 2. Impurities such as fiber, additives, etc. contained in the recycled toner Tr and exposed to the outside of the developing agent layer as a result of the rotation of the developing roller 14*a* and the developing agent eared on the sleeve 14*c* by the $S_1$ pole are electrostatically adsorbed by the adsorbing roller 14*i* applied with a bias voltage. Between the outer surface of the conductive brush portion of the adsorbing roller 14*i* and that of the developing roller 14*a*, a prescribed gap G is defined. An undesirable change in the polarity of potential generated by a potential difference between the developing bias voltage applied to the developing roller 14*a* and the adsorbing bias voltage applied to the adsorbing roller 14*i* is prevented by the gap G. The gap G is set, for instance, at 4 mm in case of a developing device using a two-component developing agent.

There is a cleaner 14*j* provided at a position where it cab be brought in contact with the outer portion of the adsorbing roller 14*i*. The cleaner 14*j* is formed from an elastic body such as a phosphor bronze spring or spring stainless steel. Such impurities as fiber, additives, etc. recovered by the adsorbing roller 14*i* are removed from the adsorbing roller 14*i* when the tip of the cleaner 14*j* contacts the conductive brush portion of the adsorbing roller 14*i*.

The cleaner 14*j* is fixed to, for instance, the doctor blade 14*h* or the housing 14*d*. A horizontal plane portion in a space required for accumulating a prescribed volume of impurities is formed on the cleaner 14*j* so as to 10 prevent impurities from adhering to the developing roller 14*a* again from the adsorbing roller 14*i*.

Next, the printing operation of a laser exposure copying machine with the present invention applied will be described in detail.

The photosensitive drum 10 is rotated at a prescribed speed by the main motor driven by the motor driving pulse transmitted from the motor driving circuit 112 which is controlled by the main controller 100. At the same time, the surface of the photosensitive drum 10 is uniformly charged to a prescribed level of surface potential by charge supplied from the main charger 12.

The volume of corona discharge emitted to the photosensitive drum 10 from the corona wire 12*a* of the main charger 12 is adjusted properly by the grid bias voltage applied to the grid screen 12*b*. For instance, the grid bias voltage applied to the grid screen 12*b* from the grid bias voltage generator 104 is about −650 V and an initial surface potential that is supplied to the photosensitive drum 10 by a high voltage from the high voltage generator 102 via the corona wire 12*a* is set at about −600 V.

In succession, a laser beam of which intensity is modulated according to a print signal corresponding to an image to be output for copying or printing, that is an image data corresponding to an image of an original document D or an image signal supplied from a host device (not shown) is applied to the surface of the photosensitive drum 10 by the laser exposing device 40. When the laser beam is applied from the laser exposing device 40, an electrostatic latent image corresponding to a print signal (image data) is formed on the outer surface of the photosensitive drum 10. The electrostatic latent image thus formed is developed by the toner T fed from the developing roller 14*a* of the developing device 14 to which, for instance, −400 V developing bias voltage is being applied by the developing bias generator 106. In the developing process, a developing agent is formed in the shape of a brush on the outer surface of the developing roller 14*a* along the magnetic line generated from the main magnet pole of the magnetic member 14*b* fixed to the inside of the sleeve 14*c*. That is, in the developing area wherein the photosensitive drum 10 and the developing roller 14*a* are opposed to each other, the carrier C is raised like the earing along the magnetic line and the toner T adhered to the developing roller 14*a* by the image force is moved to the photosensitive drum 10 by the electric field formed by the potential of the electrostatic latent image formed on the photosensitive drum 10 and the developing bias voltage. By this movement, the toner T is adhered to the electrostatic latent image and it is developed. That is, a visible image is formed on the photosensitive drum 10.

As a developing agent housed in the developing device 14, a magnetic carrier in average particle size 65 μm mixed with a toner in average particle size 9 μm at 6 wt % is preferably used.

A visible image, that is, a toner image formed on the photosensitive drum 10 is transferred on a sheet paper P kept in contact on the photosensitive drum 10 by the action of the transferring device 16 applied with a prescribed transferring voltage from the high voltage generator 102.

The sheet paper P carrying the transferred toner image is separated from the surface of the photosensitive drum 10 by the action of the separating device 17 applied with a prescribed separating voltage from the separating voltage generator 108 and then, conveyed to the fixing device 62 by the conveyor belt 60. While the sheet paper P is passing through the fixing device 62, the toner image is fixed on the sheet paper P.

The sheet paper P carrying the fixed toner image is sequentially ejected on the receiving tray 66 arranged outside the copying machine 2 and is accumulated thereon.

After transferring the toner image, the photosensitive drum 10 is continuously rotated and the residual toner left thereon is removed by the cleaning device 18 and then, the surface of the photosensitive drum 10 is discharged by charge removing device 19 and is used successively for the next image forming.

A series of image formations is carried out repeatedly as described above.

Next, the toner recycling mechanism 20 will be described in detail.

The untransferred toner, that is, the recovered toner scraped off from the surface of the photosensitive drum 10 by the blade 18*a* of the cleaning device 18 is moved in the direction of the front of the cleaning device 18 (the front side in the direction orthogonal to a sheet paper P in the sectional view of the cleaning device 18 shown in FIG. 1) by the rotation of the auger 18*b*.

The recovered toner (hereinafter referred to as a recycled toner) Tr in the cleaning device 18 is conveyed to the housing 14*d* near the toner hopper 15 by a toner recycle auger 20*b* of the toner recycling mechanism 20. The auger 20*b* is continuously rotated by the main motor 120 as long as the photosensitive drum 10 is rotated. As a result, the volume of the recycled toner Tr returned to the housing 14*d* of the developing device 14 by the rotation of the auger 20*b* increases monotonously until the number of copies (the number of times of image formation) reaches a certain number of sheets (times) and thereafter, it becomes constant.

As already described, it is known that when an image is formed using a developing agent containing recycled toner Tr recovered by the toner recycling mechanism 20, a mixing ratio of fiber or additives, etc. separated from paper contained in the recycled toner Tr in the developing agent will increase in the period using the same developing agent.

Fiber or additives, etc. separated from paper and contained in a toner supplied to an electrostatic latent image on the photosensitive drum 10 by the developing roller 14*a* become the core of the toner that is electrostatically moved from the developing roller 14a, and bring toner lamps or toner particles that are not related directly to an image to adhere to the photosensitive drum 10. The toner lamps or toner particles thus adhered to the photosensitive drum 10 are transferred on a sheet paper P together with a developed toner image of an electrostatic latent image as a result of the transfer of the toner image on a sheet paper by the transferring device 16 and recognized as dropped toners on a sheet paper P, that is, stains on the blank area. The fiber or additives, etc. moved on the photosensitive drum 10 are left thereon in the adsorbed state even after toner lamps and toner particles were transferred, and recovered again by the cleaning device 18 and returned to the developing device 14 as a recycled toner.

Hereinafter, a process to remove impurities generated from paper and contained in the recycled toner Tr returned to the developing device 14 by the adsorbing roller 14i of the developing device via the toner recycling mechanism 20 will be described in detail.

Assuming that a surface potential of the photosensitive drum 10 is −600 V and a developing bias voltage is −400 V, a blank area potential is given to the adsorbing roller 14i rather than a developing bias voltage. As the developing device 14 adopted a reversal developing system, an adsorbing bias voltage applied to the adsorbing roller 14i in this case is assumed to be −1 kV.

When the developing roller 14a is rotated by the motor 122 in this state, the developing agent layer formed in a prescribed thickness on the developing roller 14a is raised in the shape of brush in the direction of the outer portion of the developing roller by the line of magnetic force from the $S_1$ pole of the magnetic member 14b opposing to the adsorbing roller 14i.

As a result, the tip portion of the conductive brush portion of the adsorbing roller 14i slightly contacts a developing agent on the outer portion of the developing roller 14a raised by the $S_1$ pole. As a result of this contact, impurities mixed in a developing agent from a recycled toner Tr contained in the developing agent, that is, fiber and additives from paper are adsorbed by the conductive brush portion of the adsorbing roller 14i. In this case, the electron moves slightly from the adsorbing roller 14i to the developing roller 14a for a potential difference between the adsorbing bias voltage applied to the adsorbing roller 14i and a developing bias voltage applied to the developing roller 14a. That is, a toner is adsorbed on the outer portion of the developing roller 14a. However, there is substantially no problem. When the adsorbing roller 14i and the developing roller 14a are conducted each other, that is, the gap G becomes too narrow, the volume of toner adhered to the outer portion of the developing roller 14a increases. So, the gap G is set at an optimum level according to the characteristic of a developing agent, a difference between one-component developing agent and two-component developing agent or the intensity of magnetic force of the $S_1$ pole of a magnetic member fixed in the developing roller.

At the position where the developing roller 14a and the adsorbing roller 14i are opposite to each other, the adsorbing roller 14i with impurities adsorbed from a developing agent is rotated by the turning force produced in connection with the flow of a developing agent that is moved by the rotation of the developing roller 14a in the same direction of an arrow c as the direction in which the photosensitive drum 10 is rotated. The conductive brush portion of the adsorbing roller 14i is brought in contact with the cleaner 14j, accumulates impurities recovered from the developing agent in the cleaner 14j and recovers impurities again from the developing agent raised by the $S_1$ pole of the developing roller 14a .

Figure 5:
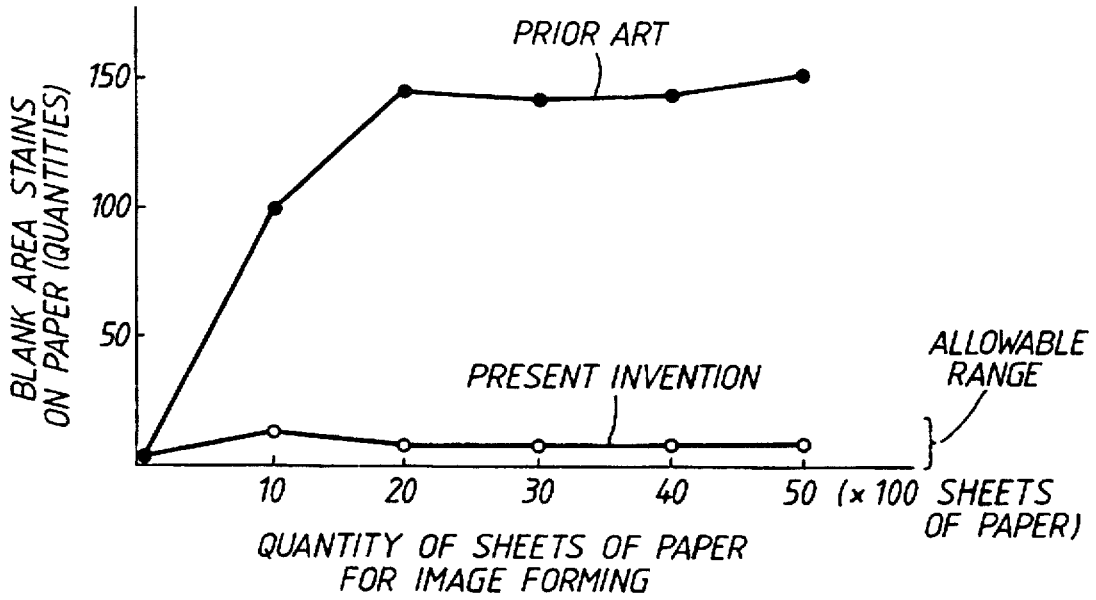
FIG. 5 is a graph showing frequencies of the white ground stain generated in the usable period of the same developing agent by the developing device shown in FIG. 3.

FIG. 5 is a graph showing frequencies of the blank area stains on paper obtained by repeating the image formation by the reversal development using the developing conditions that a surface potential of the photosensitive drum was set at −600 V, a developing bias voltage at −400 V and an adsorbing bias voltage at −1 kV.

As shown in FIG. 5, as a result of the repetitive image formation of 50,000 times using the same developing agent, it is recognized that the number of quantities (frequencies) of stains produced in the blank paper area was dropped to below the frequencies defined as the allowable range. For the purpose of comparison, the number of stains produced by a conventional developing device without using an adsorbing roller is also shown.

As described above, when an adsorbing roller applied with a blank area side voltage rather than a developing bias voltage applied to a developing agent via the developing device and the developing roller is opposed to a developing agent layer at a prescribed gap, it is possible to remove fiber or additives added to a sheet paper P causing stains of toner on a sheet paper, that is, stains on a blank area from a developing agent when utilizing a toner recovered by the cleaning device for recycling.

Figure 6:
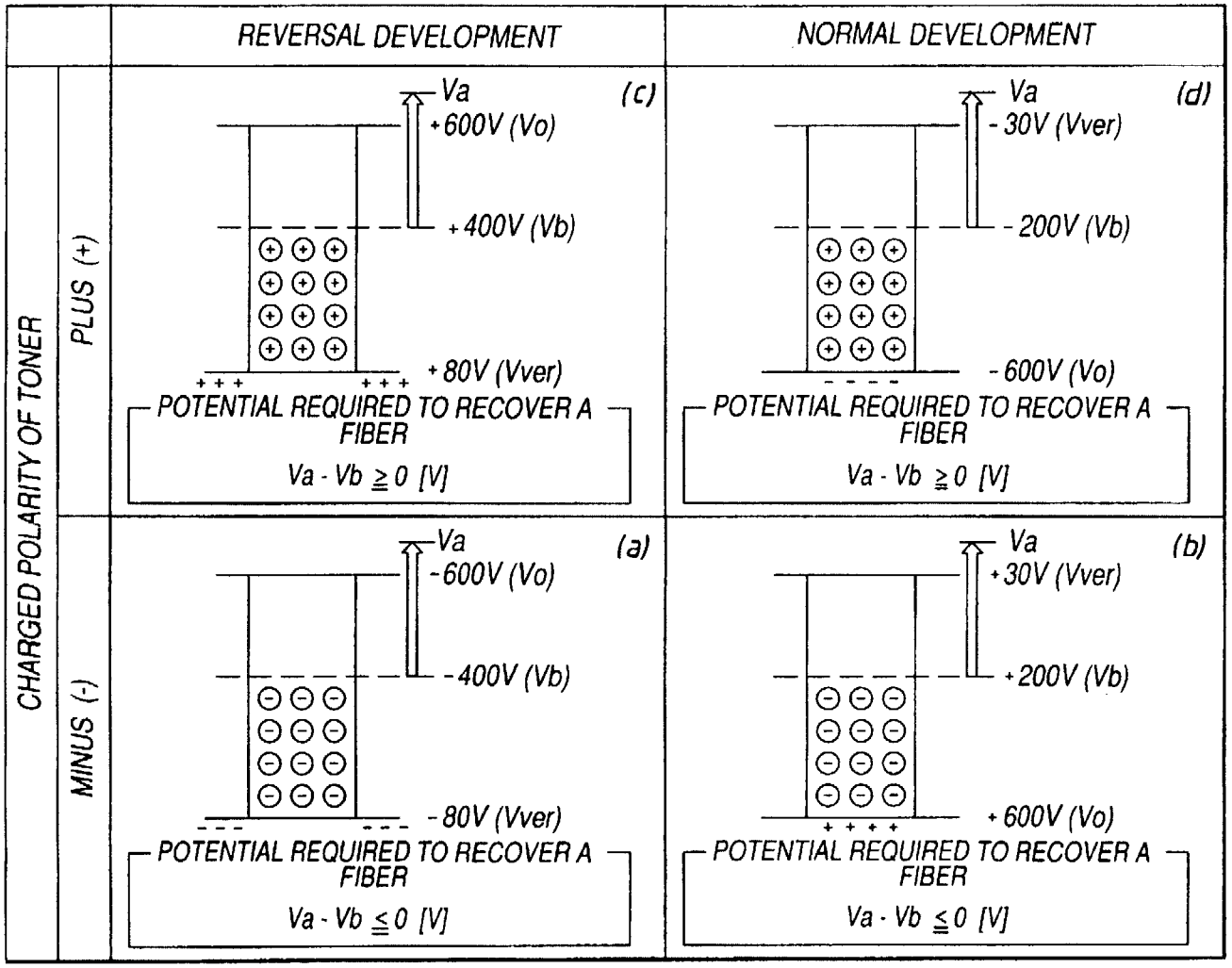
FIG. 6 is a graphical representation showing the relationship between size and polarity of the adsorbing bias voltage applied to an adsorbing roller used in the developing device shown in FIG. 3 and polarity of toner.

FIG. 6 is a graphical representation showing the relationship between polarity and size of bias voltage to be applied to the developing roller and the adsorbing roller, respectively and charging polarity of toner utilized by a normal developing type and a reversal developing type developing devices.

Here, the normal development and the reversal development will be briefly described.

When a light is applied to a photosensitive drum which is uniformly charged on its surface, a potential at the portion exposed to the light is attenuated and an electrostatic latent image is formed corresponding to the high and low levels of potential. There are two images; a negative image using portions exposed to the light as an image and a positive image using portions not exposed to the light as an image. In general, the negative image is utilized for a digital hard copy such as a laser printer while the positive image is utilized for an analog hard copy.

A toner is adhered on the surface of the photosensitive drum by an electric sucking force or a repulsion force between the plus or minus charge of a toner and the charge on the photosensitive drum to form the electrostatic latent image and an image is then developed.

The image developing by adhering a toner on a negative formed on the surface of the photosensitive drum using a repulsion force of both charges is called the reversal development.

The image developing by adhering a toner on a positive image formed on the surface of the photosensitive drum using a sucking force of both charges is called the normal development.

Assuming a developing bias voltage at Vb, an adsorbing bias voltage (impurity removable voltage) applied to the adsorbing roller at Va, a surface potential of the photosensitive drum at Vo and, a residual voltage of the photosensitive drum at Vver as shown in FIG. 6, a) In case of the reversal developing system wherein the charged polarity of a toner is minus, when assuming the developing bias voltage Vb at −400 V, the surface potential of the photosensitive drum Vo at −600 V and the adsorbing bias voltage Va satisfies the following expression:

$$Va-Vb \leqq 0$$

it becomes possible to adsorb impurities contained in a developing agent. More preferably, the adsorbing bias voltage Va is defined to be a negative voltage of a absolute value larger than the surface potential Vo, that is, −600 V which does not generate the fog. But the adsorbing bias voltage Va requires that the expression of $Va \geqq -1000$ V as not produce an electrical breakdown of the photosensitive drum.

Similarly, b) In case of the normal developing system wherein the charged polarity of a toner is minus, when assuming the developing bias voltage Vb at +200 V and the surface potential of the photosensitive drum Vo at +600 V and if the adsorbing voltage Va satisfies the following expression:

$$Va-Vb \leqq 0$$

it becomes possible to adsorb impurities. In this case, the adsorbing bias voltage Va is defined to be a plus voltage of an absolute value smaller than the developing bias voltage Vb, that is, +200 V.

On the other hand, c) In case of the reversal developing system wherein the charged polarity of a toner is plus, when assuming the developing bias voltage Vb at +400 V and the surface potential Vo of the photosensitive drum at +600 V and if the adsorbing bias voltage Va satisfies the following expression:

$$Va-Vb \geqq 0$$

it becomes possible to adsorb impurities contained in a developing agent. More preferably, the adsorbing bias voltage Va is defined to be a plus voltage of an absolute value larger than the surface potential Vo of the photosensitive drum, that is, +600 V which does not generate the fog.

Similarly, d) In case of the normal developing system wherein the charged polarity of a toner is plus, when assuming the developing bias voltage Vb at −200 V and the surface potential Vo of the photosensitive drum at −600 V and if the adsorbing bias voltage Va satisfies the following expression:

$$Va-Vb \geqq 0$$

it becomes possible to adsorb impurities. In this case, the adsorbing bias voltage Va is defined to be a minus voltage of an absolute value smaller than the developing bias voltage Vb, that is −200 V.

From the above, it is recognized that the polarity of the adsorbing bias voltage to remove impurities such as fiber or additives, etc. generated from paper mixed in a developing agent depends on the charged polarity of a toner. Further, it is also recognized that in case of the reversal development it is better to make a bias voltage to have an absolute value larger than the surface potential of the photosensitive drum.

In the above description, the surface potential of the photosensitive drum is assumed at +600 or −600 V but it may be +600 V to +1000 V or −600 V to −1000 V.

Figure 7:
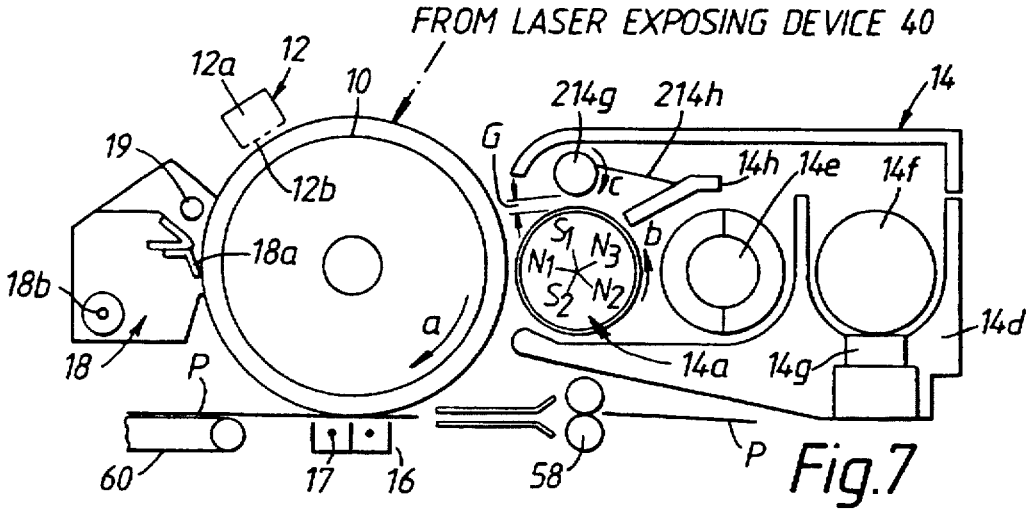
FIG. 7 is a schematic sectional view illustrating a second embodiment of the developing device used in the image forming apparatus shown in FIG. 1.
Figure 8:
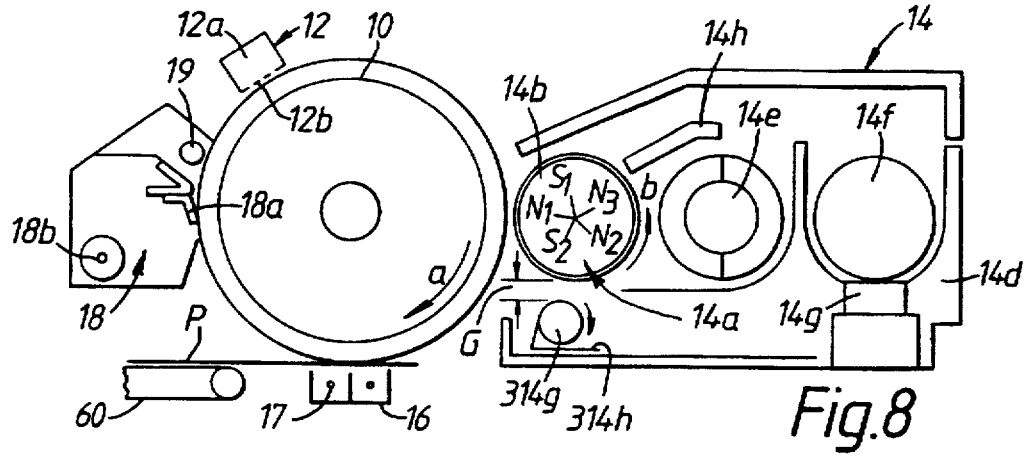
FIG. 8 is a schematic sectional view illustrating a third embodiment of the developing device used in the image forming apparatus shown in FIG. 1.
Figure 9:
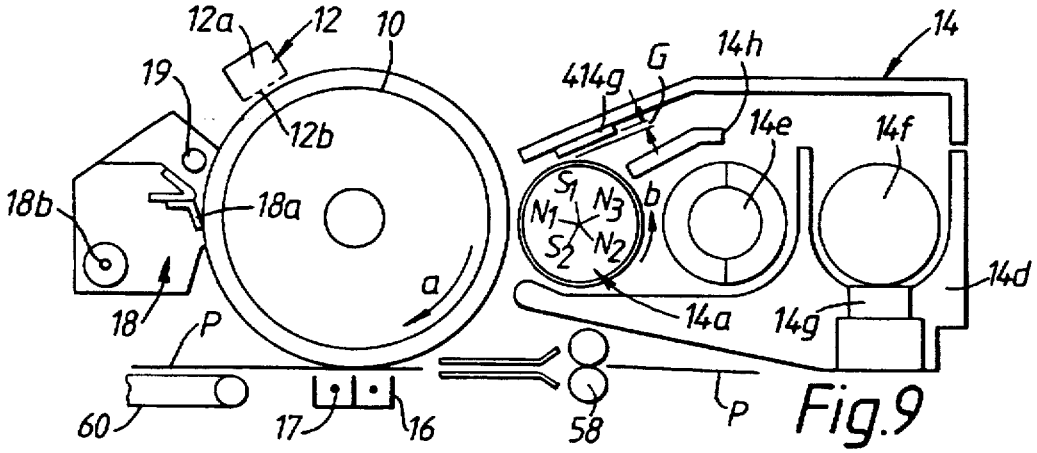
FIG. 9 is a schematic sectional view illustrating a fourth embodiment of the developing device used in the image forming apparatus shown in FIG. 1.

FIG. 7 through FIG. 9 are schematic sectional views illustrating a second through a fourth embodiments of the developing device used in the image forming apparatus shown in FIG. 1.

In FIG. 7 illustrating the second embodiment, a conductive member formed in the shape of a roller with resistance controlled by adding a prescribed amount of carbon or other conductive materials to an elastic body such as urethane or foamed rubber is shown as an adsorbing roller **214*g*. The absorbing roller 214*g* is rotated in a direction shown by an arrow c by a driving mechanism (not shown). After forming a roller body using urethane or foam rubber, a conductive blade member having a prescribed resistance may be provided on the surface of the roller. There is a cleaner 214*h* provided at a position where it can be brought in contact with the outer portion of the adsorbing roller 214*g*. The cleaner 214*h* is formed from an elastic body such as a phosphor bronze spring or spring stainless steel. Such impurities as fiber, additives, etc. recovered by the adsorbing roller 214*g* are removed from the adsorbing roller 214*g* when the tip of the cleaner 214*h* contacts the conductive brush portion of the adsorbing roller 214*g***.

In FIG. 8 illustrating the third embodiment, as an example of an adsorbing roller **314*g*, a roller formed in the same manner as the adsorbing roller 214*g* shown in FIG. 7 illustrating the second embodiment is arranged on the opposite side to the $S_2$ pole of the magnet member 14*b* of the developing roller 14. The adsorbing roller 314*g* is rotated by a driving mechanism (not shown) at the position opposite to the developing roller 14*a* in the same direction as the developing roller 14*a*. There is a cleaner 314*h* provided at a position where it can be brought in contact with the outer portion of the adsorbing roller 314*g*. The cleaner 314*h* is formed from an elastic body such as a phosphor bronze spring or spring stainless steel. Such impurities as fiber, additives, etc. recovered by the adsorbing roller 314*g* are removed from the adsorbing roller 314*g* when the tip of the cleaner 314*h* contacts the conductive brush portion of the adsorbing roller 314*g*. Further, it is needless to say that a roller with the conductive brush formed as shown in FIG. 3** may be used. Further, according to this construction, as the probability of undesirable impurities recovered from a developing agent for mixing again into a developing agent is decreased, the usable period of the same developing agent is improved.

In FIG. 9 illustrating a fourth embodiment, an example to use a conductive blade member **414*g* of which resistance is controlled in proportion to the rollers shown in FIG. 7 and FIG. 8** as an adsorbing electrode.

According to the construction shown here, a dimension of height of the developing device 14 can be reduced.

As described in detail in the above, according to the image forming apparatus of the present invention, it is possible to certainly remove fiber generated from paper and additives added to paper contained in a developing toner mixed with a toner recycled by the toner recycling mechanism.

As a result, frequencies generating undesirable blank area stains on a sheet paper are reduced within the range of the usable period of the same developing agent.

What is claimed is:

1. An image forming apparatus comprising:

means for forming an electrostatic latent image on an image carrier;

a developing agent carrying member for carrying a developing agent which is charged with a prescribed polarity and for supplying the developing agent to the electrostatic latent image to form a developed image, the developing agent carrying member including a rotatable non-magnetic sleeve on which the developing agent is carried, and a magnet member fixed in the sleeve with magnetic poles N and S arranged alternately along a circumferential direction, wherein one of the magnetic poles of the magnetic member is opposed to the image carrier and another one is opposed to a contact member;

first applying means for applying a prescribed developing bias voltage to the developing agent carrying member;

the contact member for contacting with the developing agent carried on the developing agent carrying member in brush shape, the contact member including a brush roller which is composed of a conductive brush having a prescribed resistance, arranged at a prescribed distance away from a surface of the sleeve and comes in contact with the developing agent carried in brush shape on the sleeve, wherein the brush roller is rotated in the same direction as that of the sleeve at a position opposite to the sleeve; and second apply means for applying an adsorbing voltage having a predetermined polarity and voltage defined by the prescribed polarity of the developing agent and the developing bias voltage so that the contact member adsorbs impurities contained in the developing agent carried on the developing agent carrying member in brush shape.

2. An image forming apparatus comprising:

means for forming an electrostatic latent image on an image carrier;

a developing agent carrying member for carrying a developing agent which is charged with a prescribed polarity and for supplying the developing agent to the electrostatic latent image to form a developed image, the developing agent carrying member including a rotatable non-magnetic sleeve on which the developing agent is carried, and a magnet member fixed in the sleeve with magnetic poles N and S arranged alternately along a circumferential direction, wherein one of the magnetic poles of the magnetic member is opposed to the image carrier and another one is opposed to a contact member;

first applying means for applying a prescribed developing bias voltage to the developing agent carrying member;

the contact member for contacting with the developing agent carried on the developing agent carrying member in brush shape, the contact member including an elastic roller which is composed of an elastic body having a prescribed resistance, arranged at a prescribed distance away from a surface of the sleeve and comes in contact with the developing agent carried in brush shape on the sleeve, the elastic roller being rotated in the same direction as that of the sleeve at a position opposite to the sleeve; and second applying means for applying an adsorbing voltage having a predetermined polarity and voltage defined by the prescribed polarity of the developing agent and the developing bias voltage so that the contact member adsorbs impurities contained in the developing agent carried on the developing agent carrying member in brush shape.

3. An image forming apparatus comprising:

means for forming an electrostatic latent image on an image carrier;

a developing agent carrying member for carrying a developing agent which is charged with a prescribed polarity and for supplying the developing agent to the electrostatic latent image to form a developed image;

first applying means for applying a prescribed developing bias voltage to the developing agent carrying member;

a contact member for contact with the developing agent carried on the developing agent carrying member in brush shape; and second applying means for applying an adsorbing voltage having a predetermined polarity and voltage defined by the prescribed polarity of the developing agent and the developing bias voltage so that the contact member adsorbs impurities contained in the developing agent carried on the developing agent carrying member in brush shape;

wherein the electrostatic latent image formed on the image carrier is a negative image, the charged polarity of the developing agent carried on the developing agent carrying member is negative and a value of the adsorbing voltage applied to the contact member by the second applying means is defined so that it becomes negative when a value of the developing bias voltage is subtracted therefrom.

4. An image forming apparatus comprising:

means for forming an electrostatic latent image on an image carrier;

a developing agent carrying member for carrying a developing agent which is charred with a prescribed polarity and for supplying the developing agent to the electrostatic latent image to form a developed image;

first applying means for applying a prescribed developing bias voltage to the developing agent carrying member;

a contact member for contact with the developing agent carried on the developing agent carrying member in brush shape; and second applying means for applying an adsorbing voltage having a predetermined Dolarity and voltage defined by the prescribed polarity of the developing agent and the developing bias voltage so that the contact member adsorbs impurities contained in the developing agent carried on the developing agent carrying member in brush shape;

wherein the electrostatic latent image formed on the image carrier is a positive image, the charged polarity of the developing agent carried on the developing agent carrying member is negative, and a value of the adsorbing voltage applied to the contact member by the second applying means is defined so that it becomes negative when a value of the developing bias voltage is subtracted therefrom.

5. An image forming apparatus comprising:

means for forming an electrostatic latent image on an image carrier;

a developing agent carrying member for carrying a developing agent which is charged with a prescribed polarity and for supplying the developing agent to the electrostatic latent image to form a developed image;

first applying means for applying a prescribed developing bias voltage to the developing agent carrying member;

a contact member for contacting with the developing agent carried on the developing agent carrying member in brush shape; and second applying means for applying an adsorbing voltage having a predetermined polarity and voltage defined by the prescribed polarity of the developing agent and the developing bias voltage so that the contact member adsorbs impurities contained in the developing agent carried on the developing agent carrying member in brush shape;

wherein the electrostatic latent image formed on the image carrier is a negative image, the charged polarity of the developing agent carried on the developing agent carrying member is positive, and a value of the adsorbing voltage applied to the contact member by the second applying means is defined so that it becomes positive when a value of the developing bias voltage is subtracted therefrom.

6. An image forming apparatus comprising;

means for forming an electrostatic latent image on an image carrier;

a developing agent carrying member for carrying a developing agent which is charged with a prescribed polarity and for supplying the developing agent to the electrostatic latent image to form a developed image;

first applying means for applying a prescribed developing bias voltage to the developing agent carrying member;

a contact member for contacting with the developing agent carried on the developing agent carrying member in brush shape; and second applying means for applying an adsorbing voltage having a Predetermined polarity and voltage defined by the prescribed polarity of the developing agent and the developing bias voltage so that the contact member adsorbs impurities contained in the developing agent carried on the developing agent carrying member in brush shape;

wherein the electrostatic latent image formed on the image carrier is a positive image, the charged polarity of the developing agent carried on the developing agent carrying member is positive, and a value of the adsorbing voltage applied to the contact member by the second applying means is defined so that it becomes positive when a value of the developing bias voltage is subtracted therefrom.

7. An image forming apparatus comprising:

means for forming an electrostatic latent image on an image carrier;

a developing agent carrying member having a plurality of magnetic poles for carrying a developing agent which is charged with a prescribed polarity and for supplying the developing agent to the electrostatic latent image to form a developed image, the developing agent carrying member including a rotatable non-magnetic sleeve on which the developing agent is carried, and a magnetic member fixed in the sleeve with the magnetic poles N and S arranged alternately along a circumferential direction, wherein one of the magnetic poles of the magnetic member is opposed to the image carrier and another one is opposed to an impurities removing means;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic poles of the developing agent carrying member for removing impurities contained in the developing agent on the developing agent carrying means, the impurities removing means including a brush roller which is composed of a conductive brush, arranged at a prescribed distance away from a surface of the sleeve, comes in contact with the developing agent carried on the sleeve in brush shaDe and has a prescribed resistance, the brush roller being rotated in the same direction as that of the sleeve at a position opposing to the sleeve; and second applying means for applying to the impurities removing means a prescribed bias voltage defined by a charged polarity of the developing agent and the developing bias voltage of the first applying means.

8. An image forming apparatus comprising:

means for forming an electrostatic latent image on an image carrier;

a developing agent carrying member having a plurality of magnetic poles for carrying a developing agent which is charged with a prescribed polarity and for supplying the developing agent to the electrostatic latent image to form a developed image, the developing agent carrying member including a rotatable non-magnetic sleeve on which the developing agent is carried, and a magnetic member fixed in the sleeve with the magnetic poles N and S arranged alternately along a circumferential direction, wherein one of the magnetic poles of the magnetic member is opposed to the image carrier and another one is opposed to an impurities removing means;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic poles of the developing agent carrying member for removing impurities contained in the developing agent on the developing agent carrying means, the impurities removing means including an elastic roller which is composed of an elastic body having a prescribed resistance, arranged at a prescribed distance away from a surface of the sleeve, comes in contact with the developing agent carried on the sleeve in brush shape, the elastic roller being rotated in the same direction as that of the sleeve at a position opposing to the sleeve; and second applying means for applying to the impurities removing means a prescribed bias voltage defined by a charged polarity of the developing agent and the developing bias voltage of the first applying means.

9. An image forming apparatus comprising:

means for forming an electrostatic latent image on an image carrier;

a developing agent carrying member having a plurality of magnetic poles for carrying a developing agent which is charged with a prescribed polarity and for supplying the developing agent to the electrostatic latent image to form a developed image;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic poles of the developing agent carrying member for removing impurities contained in the developing agent on the developing agent carrying means; and second applying means for applying to the impurities removing means a prescribed bias voltage defined by a charged polarity of the developing agent and the developing bias voltage of the first applying means;

wherein the electrostatic latent image formed on the image carrier is a negative image, the charged polarity of the developing agent carried on the developing agent carrying member is negative, and a value of the adsorbing voltage applied to the impurities removing means by the second applying means is defined so that it becomes negative when a value of the developing bias voltage is subtracted therefrom.

10. A image forming apparatus comprising:

means for forming an electrostatic latent image on an image carrier;

a developing agent carrying member having a plurality of magnetic poles for carrying a developing agent which is charged with a prescribed polarity and for supplying the developing agent to the electrostatic latent image to form a developed image;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic poles of the developing agent carrying member for removing impurities contained in the developing agent on the developing agent carrying means; and second applying means for applying to the impurities removing means a prescribed bias voltage defined by a charged polarity of the developing agent and the developing bias voltage of the first applying means;

wherein the electrostatic latent image formed on the image carrier is a positive image, the charged polarity of the developing agent carried on the developing agent carrying member is negative, and a value of the adsorbing voltage applied to the impurities removing means by the second applying member is defined so that it becomes negative when a value of the developing bias voltage is subtracted therefrom.

11. A image forming apparatus comprising:

means for forming an electrostatic latent image on an image carrier;

a developing agent carrying member having a plurality of magnetic Poles for carrying a developing agent which is charged with a prescribed polarity and for supplying the developing agent to the electrostatic latent image to form a developed image;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic soles of the developing agent carrying member for removing impurities contained in the developing agent on the developing agent carrying means; and second applying means for applying to the impurities removing means a prescribed bias voltage defined by a charred polarity of the developing agent and the developing bias voltage of the first applying means;

wherein the electrostatic latent image formed on the image carrier is a negative image, the charged polarity of the developing agent carried on the developing agent carrying member is positive, and a value of the adsorbing voltage applied to the impurities removing means by the second applying means is defined so that it becomes positive when a value of the developing bias voltage is subtracted therefrom.

12. An image forming apparatus comprising:

means for forming an electrostatic latent image on an image carrier;

a developing agent carrying member having a plurality of magnetic poles for carrying a developing agent which is charged with a prescribed polarity and for supplying the developing agent to the electrostatic latent image to form a developed image;

first applying means for applying a prescribed developing bias voltage to the developing agent carrying member;

means for transferring the developed image formed on the image carrier to an image recording medium;

developing agent removing means for removing the developing agent left on the image carrier after transferring the developed image on the image recording medium by the transferring means;

circulating means for conveying the developing agent removed from the image carrier to the developing agent carrying member and for circulating the developing agent between the developing agent carrying member and the developing agent removing means;

impurities removing means opposing closely to one of the magnetic poles of the developing agent carrying member for removing impurities contained in the developing agent on the developing agent carrying means; and second applying means for applying to the impurities removing means a prescribed bias voltage defined by a charged polarity of the developing agent and the developing bias voltage of the first applying means;

wherein the electrostatic latent image formed on the image carrier is a positive image, the charged polarity of the developing agent carried on the developing agent carrying member is positive, and a value of the adsorbing voltage applied to the impurities removing means by the second applying means is defined so that it becomes positive when a value of the developing bias voltage is subtracted therefrom.

* * * * *